US005452965A

United States Patent [19]

Hughes, Sr.

[11] Patent Number: 5,452,965

[45] Date of Patent: Sep. 26, 1995

[54] REPLACEABLE FLEXIBLE MARKER

[75] Inventor: Robert K. Hughes, Sr., Fort Myers, Fla.

[73] Assignee: Flexstake, Inc., Fort Myers, Fla.

[21] Appl. No.: 240,005

[22] Filed: May 9, 1994

[51] Int. Cl.[6] ..... E01F 9/00

[52] U.S. Cl. ..... 404/10

[58] Field of Search ..... 404/9–13, 15; 116/63 R, 209

[56] References Cited

U.S. PATENT DOCUMENTS

| | | | |
|---|---|---|---|
| 3,279,133 | 10/1966 | De Korte . | |
| 3,875,720 | 4/1975 | Russell . | |
| 4,486,117 | 12/1984 | Blau . | |
| 4,522,530 | 6/1985 | Arthur . | |
| 4,636,109 | 1/1987 | Clausen et al. . | |
| 4,729,690 | 3/1988 | Lavender et al. | 404/10 |
| 4,997,307 | 3/1991 | Schmanski . | |
| 5,004,366 | 4/1991 | Simmons . | |
| 5,205,236 | 4/1993 | Hughes . | |
| 5,307,598 | 5/1994 | West | 404/10 X |

*Primary Examiner*—Michael Powell Buiz
*Attorney, Agent, or Firm*—Grady K. Bergen

[57] ABSTRACT

An impact resistant marker having a marker base which is adapted to be secured to the ground or other substructure. The marker base has an upward protruding mandrel to which an elastomeric sleeve is mounted at one end, and at the other end to a substantially rigid, elastomeric mounting core. A pair of retaining lugs are integrally formed and protrude laterally outward from the sides of the mounting core. A replaceable tubular marker post having an elongate central opening is provided with a pair of apertures for receiving the retaining lugs when the mounting core is inserted into the central opening of the marker post. The retaining lugs prevent the tubular marker post from being pulled from the mounting core. The flexible element restores the marker post to its original position after it is struck.

21 Claims, 3 Drawing Sheets

REPLACEABLE FLEXIBLE MARKER

BACKGROUND OF THE INVENTION

1. Field of the Invention

This invention relates generally to an impact resistant marker, such as those used along roadsides.

2. Description of the Prior Art

Markers are often used in places, such as along roadsides, where there is a likelihood that the mark will be struck or hit by a passing object. Because of the costs of replacing damaged markers, the markers are preferably constructed so that they can withstand the force imparted by passing objects without being severely damaged. Flexible posts have been constructed for instance, such as those shown in U.S. Pat. No. 4,862,823, in which an elastomeric element connects a marker post to a base or support. This enables the post to bend relative to the base at the elastomeric element when struck. This minimizes the damage that would otherwise occur if the post was rigidly constructed.

U.S. Pat. No. 5,205,236 shows a flexible marker having a tubular marker post which mounts over a stiffener core. The stiffener core prevents the tubular post from deforming when struck and causes the marker to bend at the flexible element. Although the flexible element used in these markers provides a means for deflecting the marker posts so that damage is minimized, if a passing object strikes the marker post with sufficient force there is a likelihood that the post itself will sustain some damage. Thus, it is sometimes necessary for the marker posts to be replaced without replacing the whole marker assembly. It would be desirable to have a marker post can be easily removed and replaced from a marker assembly.

SUMMARY OF THE INVENTION

A new impact resistant marker is provided which has a marker post that is easily removed and replaced from the marker assembly. The marker has a marker base which is adapted to be secured to the ground of other substructure. An elongated mounting core having a longitudinal axis and a mounting end is made from a substantially rigid material. An elastomeric, flexible element is coupled at a first end to the base and at an opposite, second end to the mounting end of the mounting core so that the mounting core is flexibly coupled to the base. There is at least one retaining lug which is secured to and protrudes laterally outward from the side of the mounting core. A marker post has an elongate cavity which is defined by a cavity wall. The cavity wall may be made from substantially resilient material. The mounting core inserts into the cavity of the marker post and the retaining lug is received within an aperture formed in the cavity wall. The retaining lug may have an inclined surface which slopes from the side of the mounting core to facilitate insertion of the mounting core into the cavity.

Once mounted, the retaining lug effectively secures the marker post to the mounting core. The mounting core causes the marker post to pivot at the flexible element, when struck, from an original position to a deflected position. The flexible element then restores the marker post to the original position after it is struck. The retaining lug may also be provided with a side camming surface which causes the cavity wall of the marker post to be deformed from an original configuration when the marker post is rotated about the longitudinal axis of the mounting core. This causes the aperture to be forced away from the retaining lugs so that the marker posts can be easily removed from the mounting core.

DETAILED DESCRIPTION OF THE INVENTION

Figure 1:
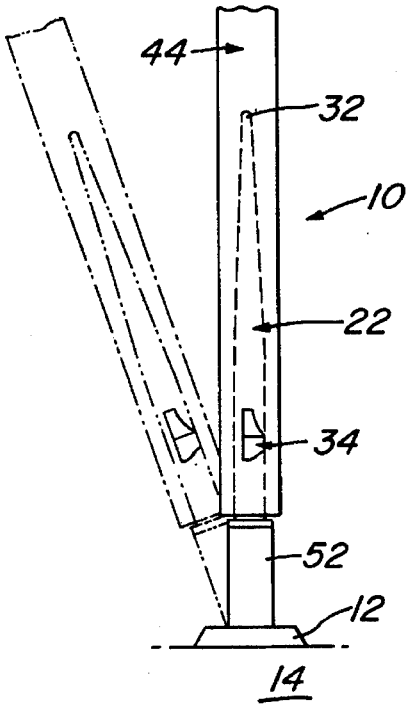
FIG. 1 is a side view of a marker constructed in accordance with the invention.

Referring to the figures, FIG. 1 shows a roadway marker 10 of the present invention, having a base 12 which is secured to a substructure 14, such as the ground. The base 10 may have an anchoring member (not shown) which is driven into the ground or may be flat on the bottom for securing to asphalt or concrete by a suitable adhesive.

Figure 2:
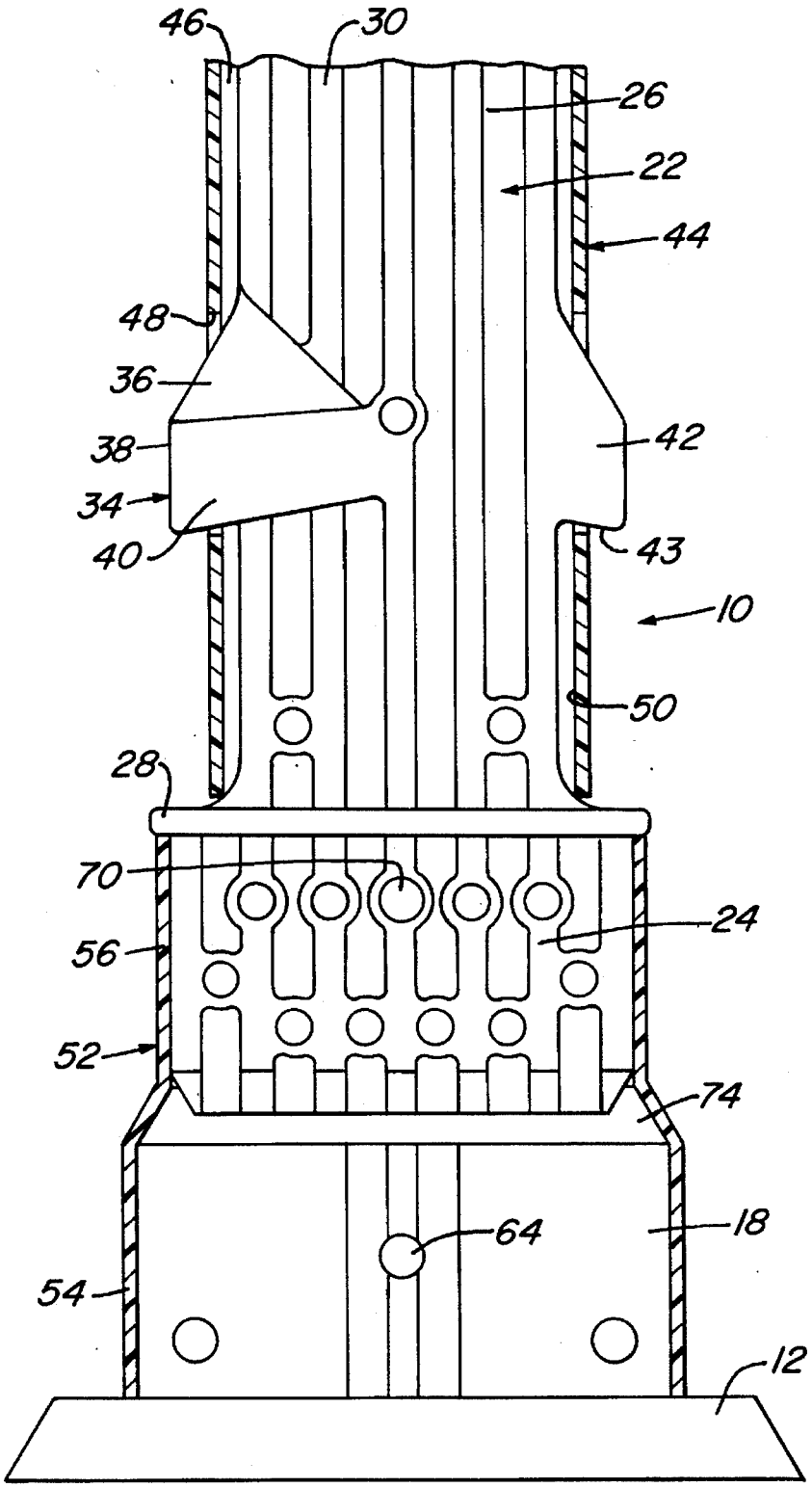
FIG. 2 is a sectional side view of the marker of FIG. 1.

As shown in FIG. 2, the base 12 has an upward protruding mandrel 18 which extends from an upper surface of the base 12. An elongate mounting core 22 having a longitudinal axis is also shown in FIG. 2. The mounting core 22 has a lower mounting portion 24 and an upper marker portion 26. The mounting core 22 is formed from a solid, substantially rigid piece of elastomeric material. The mounting portion 24 and the lower end of the marker portion 26 both have an substantially elliptical cross sectional shape (FIG. 4) wherein the width has the greater dimension and the thickness has the smaller dimension. The width of the mounting portion 24 is greater than the width of the marker portion 26. A flat guard member 28 locates between and separates the upper end of the mounting portion 24 from the lower end of the marker portion 26. The guard member 28 also has an elliptical shape and has a width which is greater than the width of the mounting portion 24 and the marker portion 26.

The mounting core 22 is provided with a plurality of ribs or splines 30 which give the mounting core 22 structural rigidity. The marker portion 26 of the mounting core 22 tapers from the elliptical shaped lower end to a substantially flat upper end 32, as shown in FIGS. 1 and 5.

Figure 3:
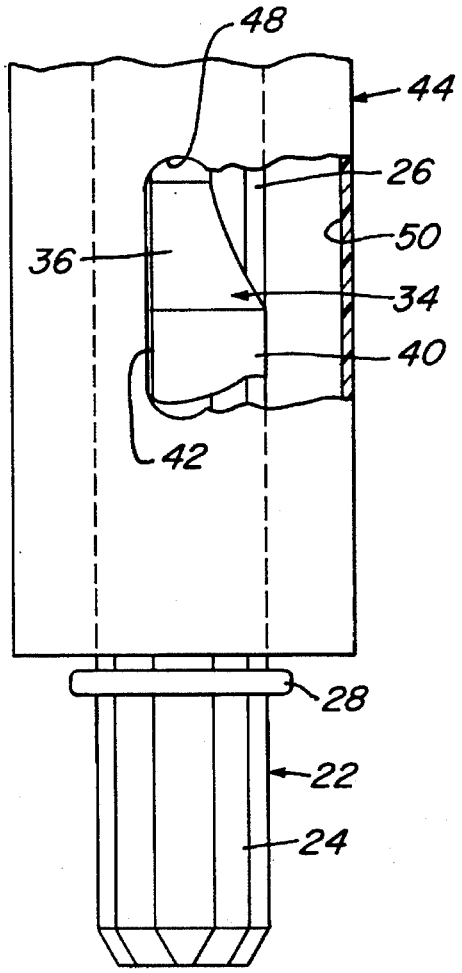
FIG. 3 is a front side view of a mounting core and marker post with a portion of the marker post cut away.
Figure 4:
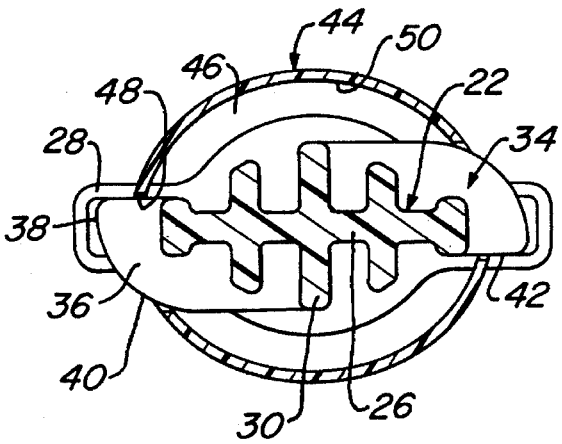
FIG. 4 is a sectional view of the marker of FIG. 3 taken along the lines IV—IV.

Referring to FIGS. 2–4, the mounting core 22 is provided with a pair of lugs 34 which extend laterally outward from opposite sides of the marker portion 26. Each of the lugs 34 has an inclined upper surface which slopes downward from the side of the marker portion 26. Each of the lugs 34 terminates at an outer end 38. The outer ends 38 are spaced apart a distance greater than the width of the marker portion 26. Each of the lugs 34 has a side camming surface 40 which is a convex curved or arcuate surface which curves toward the outer most end 38. As shown in FIG. 4, the side camming surfaces 40 of the lugs 34 are located opposite from each other, on opposite sides of the marker portion 26 of the mounting core 22. Opposite the side camming surface 40, on each lug 34, is a flat side portion 42 located in a plane parallel to the longitudinal axis of the mounting core 22. The lower surface 43 of each retaining lug 34 is inclined with the lower surface sloping upward from the end 38 of the lug 34 to the marker portion 26 of the mounting core 22.

A tubular marker post 44 having an elongate central opening or cavity 46 is formed from a substantially resilient polymeric material. The central cavity 46 is defined by a cavity wall 50 which is provided with a pair of apertures 48 located near the lower end and on opposite sides of the tubular marker post 44. The apertures 48 extend through the walls 50 of the tubular marker post 44 and are elliptical or oval in shape with the longer dimension being parallel to the longitudinal axis of the marker post 44. As shown in FIG. 4, the tubular marker post 44 has an elliptical or circular cross section. When the marker post 44 is mounted to the mounting core 22, the retaining lugs 34 are received within the apertures 48. This effectively secures the marker post 44 to the mounting core 22.

Figure 5:
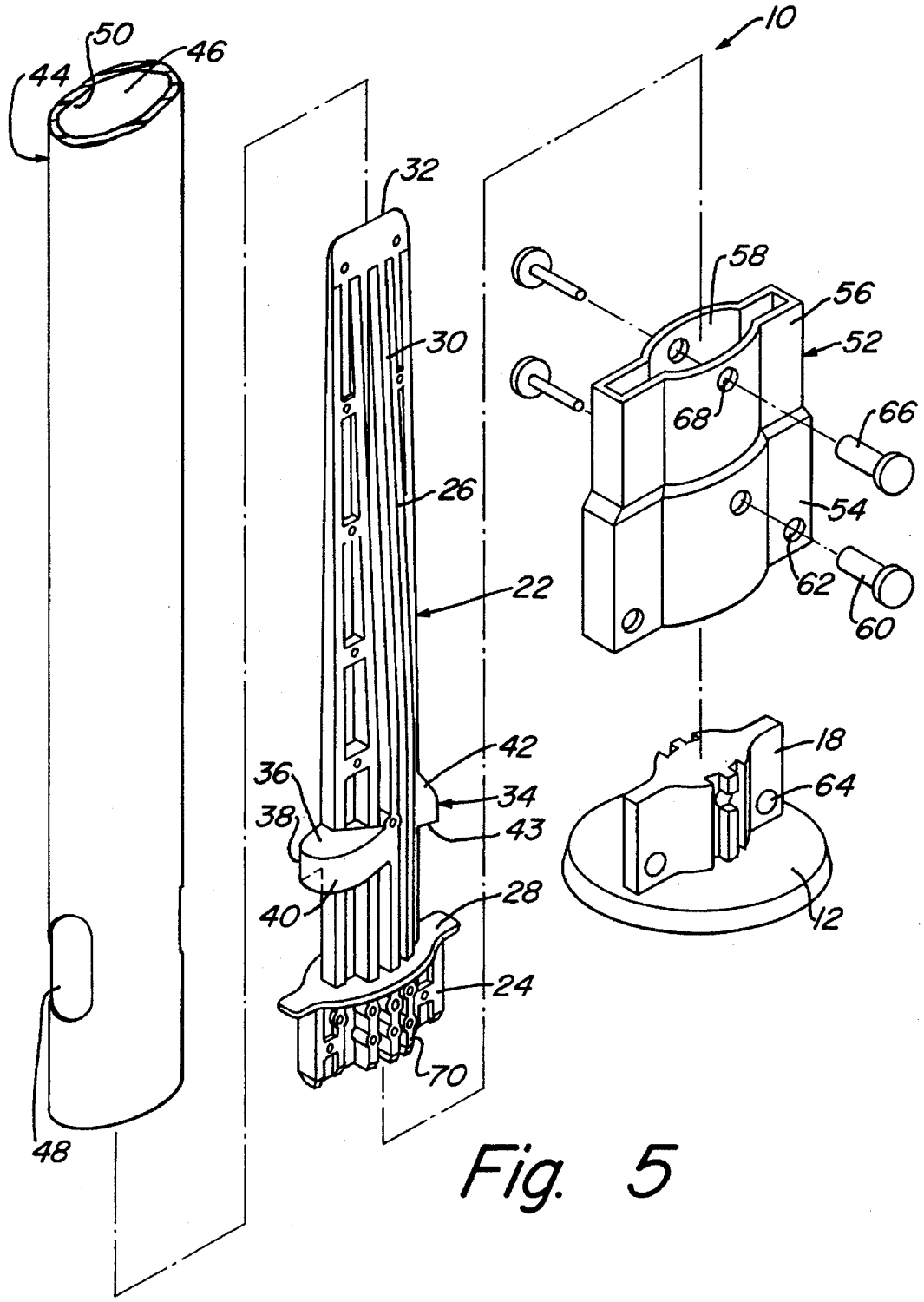
FIG. 5 is an exploded perspective view of the marker of FIG. 1.

As shown in FIG. 2, a flexible elastomeric sleeve 52 having a lower end 54 and an upper end 56 is provided with an opening 58 (FIG. 5). The opening 58 in the flexible sleeve 52 is configured to closely receive the mandrel 18 of the base 12 and mounting portion 24 of the mounting core 22, with the upper end 56 of the sleeve 52 receiving the mounting portion 24 of the mounting core 22 and the lower end 54 of the sleeve 52 receiving the mandrel 18 of the base 12. Fasteners 60, such as rivets or bolts, are used to secure the lower end 54 of the flexible sleeve 52 to the mandrel 18. The fasteners 60 are inserted through holes 62 and 64 in the sleeve 52 and mandrel 18, respectively. Likewise, fasteners 66 are inserted through holes 68, 70 in the sleeve 52 and mounting core 22 to secure the upper end 56 of the sleeve 52 to the mounting portion 24 of the mounting core 22. As shown in FIG. 2, a clearance 74 exists between the lower end of mounting portion 24 and the upper end of the mandrel 18. The mounting core 22 is thus flexibly coupled to the base 12.

The marker post 44 is mounted to the mounting core 22 as follows. With the marker post 44 initially removed from the mounting core 22, the lower end of the marker post 44 is positioned over the upper end 32 of the mounting core 22 with the longitudinal axis of the marker post 44 being substantially parallel to the longitudinal axis of the mounting core 22. The marker post 44 is then lowered so that the mounting core 22 inserts into the central cavity 46 of the tubular marker post 44. As the marker post 44 is lowered, the lower end of the marker post 44 contacts the inclined upper surfaces 36 of the lugs 34 so that the cavity wall 50 of the marker post deforms from its initial configuration and expands over the lugs 34. The marker post 44 should be oriented so that the apertures 48 are aligned with the lugs 34 when the marker post 44 is lowered over the mounting core 22 so that they are received within the apertures 48 in the cavity wall 50 of the marker post 44. When this occurs, the lower portion of the marker post 44 is restored to its initial configuration with the lower end of the marker post 44 resting on or adjacent to the guard member 28 which divides the mounting portion 44 from the marker portion 26. The marker post 44 is thus effectively secured to the mounting core 22. If the tubular marker post 44 is pulled upward along lines generally parallel with the longitudinal axis of the mounting core 22, the inclined lower surface 43 of the retaining lugs 34 will contact the lower edges of the apertures 48 preventing demounting of the marker post 44.

When the marker post 44 is struck, the marker post 44 and mounting core 22 pivot from their original position at the flexible element 52 to a deflected position, as shown by the dashed lines in FIG. 1. The mounting core 22 gives the marker post 44 a desired stiffness so that the marker 10 bends at the flexible sleeve 52, approximately at the clearance 74, instead of deforming the marker post 44. The flexible element 52 then restores the mounting core 22 and marker post 44 to their original upright or undeflected position.

To remove the marker post 44, the lower end of the marker post 44 is rotated around the longitudinal axis of the mounting core 22. This causes the side edges of the apertures 48 in the cavity wall 50 of the marker post 44 to slide along the side camming surface 40 of each of the retaining lugs 34. The camming surface 40 of the retaining lugs 34 causes the cavity wall 50 of the marker post 44 to be deformed so that the apertures 48 are forced away from the retaining lugs 34 and the ends 38 of the lugs 34 locate within the interior of the cavity wall 50. The marker post 44 is pulled and slipped off the mounting core 22. A new marker post can then be mounted over the mounting core 22 as previously described.

The marker of the invention has several advantages. The marker is flexible so that when struck it may bend, thereby reducing any damage that would otherwise occur to the mark post or marker post assembly. The lugs on the mounting core allow for a marker post to be easily positioned and mounted to the mounting core by merely inserting the mounting core into the marker post so that the retaining lugs protrude through the apertures in the marker post. The marker post is easily removed from the mounting core by merely twisting the lower end of the marker post and pulling the marker post from the mounting core.

While the invention has been shown in only one of its forms, it should be apparent to those skilled in the art that it is not so limited, but it is susceptible to various changes without departing from the scope of the invention.

I claim:

1. An impact resistant marker, comprising in combination:

a marker base adapted to be secured to a substructure;

an elongate mounting core having a longitudinal axis and a mounting end, the mounting core being made of a substantially rigid material;

an elastomeric, flexible element which is coupled at a first end to the base and at an opposite, second end to the mounting end of the mounting core for flexibly coupling the mounting core to the base;

a marker post having an elongate cavity defined by a cavity wall, the cavity wall having an aperture, the mounting core inserting into and extending into the cavity; and retaining means which extends through the aperture when the marker post is inserted over the core for securing the marker post to the mounting core, and wherein the mounting core causes the marker post to pivot at the flexible element from an original position to a deflected position when the marker post is struck, the flexible element restoring the marker post to the original position after being struck.

2. The impact resistant marker of claim 1, wherein:

the retaining means comprises a retaining lug which is secured to and protrudes laterally outward from a side of the mounting core.

3. The marker of claim 2, wherein:

the retaining lug is integral with the mounting core, both being formed of an elastomeric material.

4. The marker of claim 2, wherein:

the cavity wall of the marker post is made of a substantially resilient material so that the cavity wall deforms from an initial configuration to accommodate the retaining lug as the mounting core is inserted into the cavity, the cavity wall being restored to the initial configuration when the retaining lug is received within the aperture.

5. The marker of claim 4, wherein:

the retaining lug has a side camming surface which causes the cavity wall of the marker post to be deformed from the initial configuration when the marker post is rotated about the longitudinal axis of the mounting core so that the aperture is forced away from the retaining lug and the marker post can be removed from the mounting core.

6. An impact resistant marker, comprising in combination:

a marker base adapted to be secured to a substructure;

an elongate mounting core having a longitudinal axis and a mounting end, the mounting core being made of a substantially rigid material;

at least one retaining lug which is secured to and protrudes laterally outward from a side of the mounting core;

an elastomeric, flexible element which is coupled at a first end to the base and at an opposite, second end to the mounting end of the mounting core for flexibly coupling the mounting core to the base; and a marker post having an elongate cavity defined by a cavity wall, the cavity wall having an aperture, the mounting core inserting into and extending into the cavity with the retaining lug being received within the aperture to effectively secure the marker post to the mounting core when the marker post is in a mounted position, and wherein the mounting core causes the marker post to pivot at the flexible element from an original position to a deflected position when the marker post is struck, the flexible element restoring the marker post to the original position after being struck.

7. The marker of claim 6, wherein:

the cavity wall has a pair of apertures and there are a pair of retaining lugs located on opposite sides of the mounting core, each retaining lug being received in one of the apertures.

8. The marker of claim 6, wherein:

the cavity wall of the marker post is made of a substantially resilient material so that the cavity wall deforms from an initial configuration to accommodate the retaining lug as the mounting core is inserted into the cavity, the cavity wall being restored to the initial configuration when the retaining lug is received within the aperture.

9. The marker of claim 8, wherein:

the retaining lug has a side camming surface which causes the cavity wall of the marker post to be deformed from the initial configuration when the marker post is rotated about the longitudinal axis of the mounting core so that the aperture is forced away from the retaining lug and the marker post can be removed from the mounting core.

10. The marker of claim 6, wherein:

the retaining lug has an inclined surface which slopes from the side of the mounting core to facilitate insertion of the mounting core into the cavity.

11. The marker of claim 6, wherein:

the retaining lug is integral with the mounting core, both being formed of an elastomeric material.

12. The marker of claim 6, wherein:

the marker base has an upward protruding mandrel; and the elastomeric element is a sleeve having first and second ends, the first end of the sleeve mounting over the mandrel, the second end of the sleeve mounting over the mounting end of the mounting core.

13. An impact resistant road marker, the marker comprising in combination:

a marker base adapted to be secured to the ground;

an elongate mounting core having a longitudinal axis and a mounting end, the mounting core being made of a substantially rigid elastomeric material;

a pair of retaining lugs which are secured to and protrude laterally outward from opposite sides of the mounting core;

an elastomeric, flexible element which is coupled at a first end to the base and at an opposite, second end to the mounting end of the mounting core for flexibly coupling the mounting core to the base; and a marker post having an elongate, central cavity defined by a cavity wall, the cavity wall having a pair of apertures, the mounting core inserting and extending into the cavity with the retaining lugs being received within the apertures so that the marker post is effectively secured to the mounting core when in a mounted position, and wherein the mounting core causes the marker post to pivot at the flexible element from an original position to a deflected position when the marker post is struck, the flexible element restoring the marker post to the original position after being struck.

14. The marker of claim 13, wherein:

the cavity wall of the marker post is made of a substantially resilient material so that the cavity wall deforms from an initial configuration to accommodate the retaining lugs as the mounting core is inserted into the cavity, the cavity wall being restored to the initial configuration when the retaining lugs are received within the apertures.

15. The marker of claim 14, wherein:

the retaining lugs each having a side camming surface which causes the cavity wall of the marker post to be deformed from the initial configuration when the marker post is rotated about the longitudinal axis of the mounting core so that the apertures are forced away from the retaining lugs and the marker post can be removed from the mounting core.

16. The marker of claim 13, wherein:

the retaining lugs each have an inclined surface which slopes from the side of the mounting core to facilitate insertion of the mounting core into the cavity.

17. The marker of claim 13, wherein:

the retaining lugs are integral with the mounting core.

18. The marker of claim 13, wherein:

the marker base has an upward protruding mandrel; and the elastomeric element is a sleeve having opposite first and second ends, the first end of the sleeve mounting over the mandrel, the second end of the sleeve mounting over the mounting end of the mounting core.

19. An impact resistant road marker, the marker comprising in combination:

a marker base adapted to be secured to the ground, the base having an upward protruding mandrel;

an elongate mounting core having a longitudinal axis and a mounting end, the mounting core being made of a substantially rigid elastomeric material;

a pair of retaining lugs which are integrally formed with and protrude laterally outward from opposite sides of the mounting core;

an elastomeric, flexible sleeve which is mounted over and coupled at a first end to the mandrel of the base and at an opposite, second end to the mounting end of the mounting core for flexibly coupling the mounting core to the base; and a tubular marker post having an elongate, central opening, the marker post having a pair of apertures, the mounting core inserting and extending into the central opening of the marker post with the retaining lugs being received within the apertures so that the marker post is effectively secured to the mounting core when in a mounted position, the marker post being made of a substantially resilient material so that the marker post deforms from an initial configuration to accommodate the retaining lugs as the mounting core is inserted into the opening, the marker post being restored to the initial configuration when the retaining lugs are received within the apertures;

and wherein the mounting core causes the marker post to pivot at the flexible element from an original position to a deflected position when the marker post is struck, the flexible element restoring the marker post to the original position after being struck.

20. The marker of claim 19, wherein:

the retaining lugs each having a side camming surface which causes the marker post to be deformed from the initial configuration when the marker post is rotated about the longitudinal axis of the mounting core so that the apertures are forced away from the retaining lugs and the marker post can be removed from the mounting core.

21. The marker of claim 19, wherein:

the retaining lugs each have an inclined surface which slopes from the side of the mounting core to facilitate insertion of the mounting core into the cavity.

* * * * *